US011213459B2

(12) United States Patent
Henry

(10) Patent No.: US 11,213,459 B2
(45) Date of Patent: Jan. 4, 2022

(54) STIRRER TO COOL OR WARM LIQUIDS

(71) Applicant: Jennifer Henry, Atlanta, GA (US)

(72) Inventor: Jennifer Henry, Atlanta, GA (US)

( * ) Notice: Subject to any disclaimer, the term of this patent is extended or adjusted under 35 U.S.C. 154(b) by 180 days.

(21) Appl. No.: 16/439,399

(22) Filed: Jun. 12, 2019

(65) Prior Publication Data

US 2019/0380914 A1 Dec. 19, 2019

Related U.S. Application Data

(60) Provisional application No. 62/684,704, filed on Jun. 13, 2018.

(51) Int. Cl.
*A61J 9/00* (2006.01)
*F25D 31/00* (2006.01)

(52) U.S. Cl.
CPC ..... *A61J 9/00* (2013.01); *F25D 31/003* (2013.01); *F25D 31/007* (2013.01)

(58) Field of Classification Search
CPC ..... A61J 9/00; A61J 2200/44; F25D 31/007; F25D 31/003; F25D 31/006; F25D 3/02; C01B 5/00
See application file for complete search history.

(56) References Cited

U.S. PATENT DOCUMENTS 2,659,579 A * 11/1953 Boyle ..... A01J 9/04 165/74
3,662,741 A * 5/1972 Licher ..... A47J 36/30 126/263.01
3,803,867 A * 4/1974 Willis ..... F25D 3/107 62/294
3,882,693 A * 5/1975 Hiller ..... F28F 1/02 62/394
5,044,173 A * 9/1991 Cheng ..... A47G 19/2288 62/372
5,456,090 A * 10/1995 McCoy ..... A61J 9/00 165/80.5
5,467,877 A * 11/1995 Smith ..... A61J 9/00 215/11.1
5,472,274 A * 12/1995 Baillie ..... A47G 19/12 222/146.6
5,502,981 A * 4/1996 Sullivan ..... A47G 23/04 220/522
6,073,452 A * 6/2000 Karp ..... A23G 9/08 62/293
6,134,894 A * 10/2000 Searle ..... B65D 1/165 62/293
6,324,864 B1 * 12/2001 Stewart ..... A47G 19/127 62/457.3
7,614,513 B2 * 11/2009 Anderson ..... B65D 81/3216 215/10
8,066,152 B2 * 11/2011 Tetreault ..... F25D 3/08 222/146.6

(Continued)

OTHER PUBLICATIONS

U.S. Appl. No. 62/684,704, filed Jun. 13, 2018, Jennifer Henry.

*Primary Examiner* — Emmanuel E Duke
(74) *Attorney, Agent, or Firm* — Ballard Spahr LLP

(57) ABSTRACT

This invention relates to an article that evenly cools a liquid in a container such as, for example, milk in an infant bottle, in a relatively short amount of time, without diluting the liquid. This abstract is intended as a scanning tool for purposes of searching in the particular art and is not intended to be limiting of the present invention.

18 Claims, 6 Drawing Sheets

(56) References Cited

U.S. PATENT DOCUMENTS

| | | | | |
|---|---|---|---|---|
| 9,802,806 | B2 * | 10/2017 | Hewitt | F25D 3/08 |
| 2001/0037872 | A1 * | 11/2001 | Sabin | F24V 30/00 165/10 |
| 2004/0123620 | A1 * | 7/2004 | Porter | F25D 31/007 62/457.3 |
| 2006/0051285 | A1 * | 3/2006 | Hawker | A61L 2/18 423/477 |
| 2012/0061050 | A1 | 3/2012 | Petrillo et al. | |
| 2012/0266625 | A1 * | 10/2012 | Hewitt | F25D 3/08 62/372 |
| 2012/0314527 | A1 * | 12/2012 | Vulliermet | B01F 7/00575 366/129 |
| 2015/0328600 | A1 * | 11/2015 | Hewitt | B01F 13/002 222/190 |
| 2016/0341464 | A1 * | 11/2016 | Bagwell, Sr. | B65D 81/3895 |
| 2017/0245678 | A1 * | 8/2017 | Wakeham | F25D 3/08 |

* cited by examiner

STIRRER TO COOL OR WARM LIQUIDS

CROSS-REFERENCE TO RELATED APPLICATIONS

This Application claims the benefit of U.S. application Ser. No. 62/684,704, filed on Jun. 13, 2018, which is incorporated herein by reference in its entirety.

BACKGROUND

Hot beverages, such as tea- and coffee-based beverages, are commonly brewed at temperatures exceeding an appropriate consumption temperature. A consumer of such a hot beverage faces three equally unsatisfying choices: (1) wait for the hot beverage to cool down; (2) add a lower-temperature consumable such as ice, cream, or milk to the beverage, usually changing the flavor of the beverage itself and often requiring additional waiting, as well; and (3) risk burning their tongue, mouth, and throat and drink it as is. Each of these options negatively impacts the consumer's enjoyment of the beverage.

Additionally, infant formula and milk is typically heated prior to serving to an infant. All too often, the infants' beverage ends up heated ever slightly too much and the caregiver must wait for the beverage to slowly cool down.

The most common method used to cool or maintain the temperature of a beverage is to place one or more ice cubes directly into the beverage. Although effective, the addition of the ice cubes ultimately dilutes the beverage with water, changing the taste. In addition, the beverage may be contaminated either by the water used to make the ice or by handling of the ice cubes by a human (e.g., when placing them into the beverage).

An alternative method used to cool a beverage is to first frost a glass before adding the beverage to the glass. However, the frost can be contaminated by other products in the freezer, resulting in an unpleasant odor. Additionally, the glass may crack when repeatedly subjected to extreme temperature differences. This technique also requires the beverage to be heated in a separate container and then transferred to the frosted glass. Moreover, the enjoyment of a beverage that is intended to be served hot or warm would be severely hampered by serving such a beverage in a cold glass.

In order to overcome these problems, various beverage cooling elements, sometimes referred to as "fake ice," have been developed. This "fake ice" typically uses a frozen liquid housed within a sealed body, which is directly placed into beverage. However, conventional "fake ice" floats on top of the beverage, striking a consumer's lips as the consumer drinks the beverage. Additionally, the "fake ice" takes up a significant amount of space within the container, leaving less room available for the beverage itself.

Accordingly, there remains a need for articles that can timely cool a liquid to a temperature that is safe for human consumption without detracting from the consumer's enjoyment of the beverage. These needs and others are met by the present invention.

SUMMARY

In accordance with the purpose(s) of the invention, as embodied and broadly described herein, the invention, in one aspect, relates to stirrers for cooling or heating liquids and methods of making and using same.

Thus, disclosed are articles for cooling a liquid contained within a container, wherein the article comprises: (a) a top end and a bottom end; (b) an exterior wall extending from the top end to the bottom end; (c) an interior wall extending from the top end to the bottom end and defining an interior cavity; and (d) a composition that undergoes a phase transition when the temperature is raised from less than about 0° C. to greater than about 20° C., wherein the composition is contained within the interior cavity, wherein the exterior wall and the interior wall consist essentially of one or more non-toxic materials, and wherein the article has a surface area to volume ratio of from about 5.0 to about 25, based on the exterior wall's surface area and the interior cavity's volume.

Also disclosed are articles for cooling a liquid contained within a container, wherein the article comprises: (a) a top end and a bottom end; (b) an exterior wall extending from the top end to the bottom end and having a coil shape; (c) an interior wall extending from the top end to the bottom end and defining an interior cavity; and (d) a composition that undergoes a phase transition when the temperature is raised from less than about 0° C. to greater than about 20° C., wherein the composition is contained within the interior cavity, wherein the exterior wall and the interior wall consist essentially of one or more non-toxic materials.

Also disclosed are articles for cooling a liquid contained within a container, wherein the article comprises: (a) a top end and a bottom end; (b) an exterior wall extending from the top end to the bottom end; (c) an interior wall extending from the top end to the bottom end and defining an interior cavity; and (d) a composition that undergoes a phase transition upon application of an external force, wherein the composition is contained within the interior cavity, wherein the exterior wall and the interior wall consist essentially of one or more non-toxic materials, and wherein the article has a surface area to volume ratio of from about 5.0 to about 25, based on the exterior wall's surface area and the interior cavity's volume.

Also disclosed are articles for cooling a liquid contained within a container, wherein the article comprises: (a) a top end and a bottom end; (b) an exterior wall extending from the top end to the bottom end and having a coil shape; (c) an interior wall extending from the top end to the bottom end and defining an interior cavity; and (d) a composition that undergoes a phase transition upon application of an external force, wherein the composition is contained within the interior cavity, wherein the exterior wall and the interior wall consist essentially of one or more non-toxic materials.

Also disclosed are methods for cooling a liquid in a container, the method comprising the step of inserting a disclosed article into the liquid, wherein the container comprises an interior wall defining an interior cavity and wherein the liquid is contained within the interior cavity.

Also disclosed are kits comprising a disclosed article and one or more of: (a) a container; and (b) instructions for cooling a liquid in a container.

While aspects of the present invention can be described and claimed in a particular statutory class, such as the system statutory class, this is for convenience only and one of skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

BRIEF DESCRIPTION OF THE FIGURES

The accompanying figures, which are incorporated in and constitute a part of this specification, illustrate several aspects and together with the description serve to explain the principles of the invention.

As shown in FIG. 2B, the handle extends up and outward from a container so that the cooling device can be easily removed.

Figure 1B:
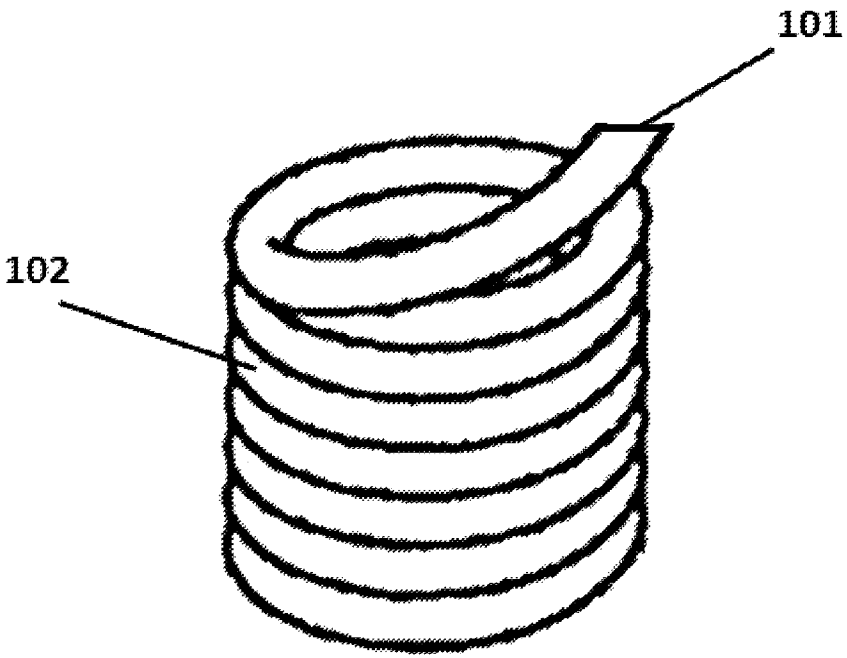
FIG. 1A and FIG. 1B show representative images of a coil-shaped cooling device in which the coils are spaced apart (FIG. 1A) and in which the coils are touching each other (FIG. 1B).

Additional advantages of the invention will be set forth in part in the description which follows, and in part will be obvious from the description, or can be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DESCRIPTION

The present invention can be understood more readily by reference to the following detailed description of the invention and the Examples and Figures included herein.

While aspects of the present invention can be described and claimed in a particular statutory class, such as the article of manufacture statutory class, this is for convenience only and one of skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

Throughout this application, various publications are referenced. The disclosures of these publications in their entireties are hereby incorporated by reference into this application in order to more fully describe the state of the art to which this pertains. The references disclosed are also individually and specifically incorporated by reference herein for the material contained in them that is discussed in the sentence in which the reference is relied upon. Nothing herein is to be construed as an admission that the present invention is not entitled to antedate such publication by virtue of prior invention. Further, the dates of publication provided herein may be different from the actual publication dates, which can require independent confirmation.

A. Definitions

As used in the specification and the appended claims, the singular forms "a," "an" and "the" include plural referents unless the context clearly dictates otherwise. Thus, for example, reference to "a top edge," "an exterior wall," or "a container" includes aspects wherein there are two or more such top edges, exterior walls, or container, and the like.

Ranges can be expressed herein as from "about" one particular value, and/or to "about" another particular value. When such a range is expressed, a further aspect includes from the one particular value and/or to the other particular value. Similarly, when values are expressed as approximations, by use of the antecedent "about," it will be understood that the particular value forms a further aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "optional" or "optionally" means that the subsequently described event or circumstance can or cannot occur, and that the description includes instances where said event or circumstance occurs and instances where it does not.

As used herein, the term "phase transition" refers to a transformation of a composition from one phase to another. For example, a phase transition can refer to a change between solid, liquid, and gaseous states of matter. The phase transition may be induced, for example, by external stimuli such as, but not limited to, temperature and external force (e.g., shaking).

As used herein, the term "non-toxic material" refers to a substance that is generally not considered to be harmful or destructive to human health. A non-toxic material may, in some instances, contain some toxicity; however, the toxicity must be evaluated in terms of the quantity of material. If the quantity of a substance that causes harm is less, its' toxicity is determined to be higher. In various aspects, a non-toxic material is approved by the Food and Drug Administration for use in food contact applications. Examples of non-toxic materials include, but are not limited to, polyethylene terephthalate, polypropylene, high-density polyethylene, low-density polyethylene, and polycarbonate.

B. Articles for Cooling a Liquid

In one aspect, disclosed are articles for cooling a liquid contained within a container, wherein the article comprises:

(a) a top end and a bottom end; (b) an exterior wall extending from the top end to the bottom end; (c) an interior wall extending from the top end to the bottom end and defining an interior cavity; and (d) a composition that undergoes a phase transition when the temperature is raised from less than about 0° C. to greater than about 20° C., wherein the composition is contained within the interior cavity, wherein the exterior wall and the interior wall consist essentially of one or more non-toxic materials, and wherein the article has a surface area to volume ratio of from about 5.0 to about 25, based on the exterior wall's surface area and the interior cavity's volume.

Also disclosed are articles for cooling a liquid contained within a container, wherein the article comprises: (a) a top end and a bottom end; (b) an exterior wall extending from the top end to the bottom end and having a coil shape; (c) an interior wall extending from the top end to the bottom end and defining an interior cavity; and (d) a composition that undergoes a phase transition when the temperature is raised from less than about 0° C. to greater than about 20° C., wherein the composition is contained within the interior cavity, wherein the exterior wall and the interior wall consist essentially of one or more non-toxic materials.

Also disclosed are articles for cooling a liquid contained within a container, wherein the article comprises: (a) a top end and a bottom end; (b) an exterior wall extending from the top end to the bottom end; (c) an interior wall extending from the top end to the bottom end and defining an interior cavity; and (d) a composition that undergoes a phase transition upon application of an external force, wherein the composition is contained within the interior cavity, wherein the exterior wall and the interior wall consist essentially of one or more non-toxic materials, and wherein the article has a surface area to volume ratio of from about 5.0 to about 25, based on the exterior wall's surface area and the interior cavity's volume.

Also disclosed are articles for cooling a liquid contained within a container, wherein the article comprises: (a) a top end and a bottom end; (b) an exterior wall extending from the top end to the bottom end and having a coil shape; (c) an interior wall extending from the top end to the bottom end and defining an interior cavity; and (d) a composition that undergoes a phase transition upon application of an external force, wherein the composition is contained within the interior cavity, wherein the exterior wall and the interior wall consist essentially of one or more non-toxic materials.

Without wishing to be bound by theory, the disclosed invention generally relates to the field of cooling liquids such as, for example, infant formula or milk, via insertion of a cooling device into the liquid. The cooling device is distinct from the container and can thus be wholly removed and placed into a freezer, cooled, and then reused.

Figure 1A:
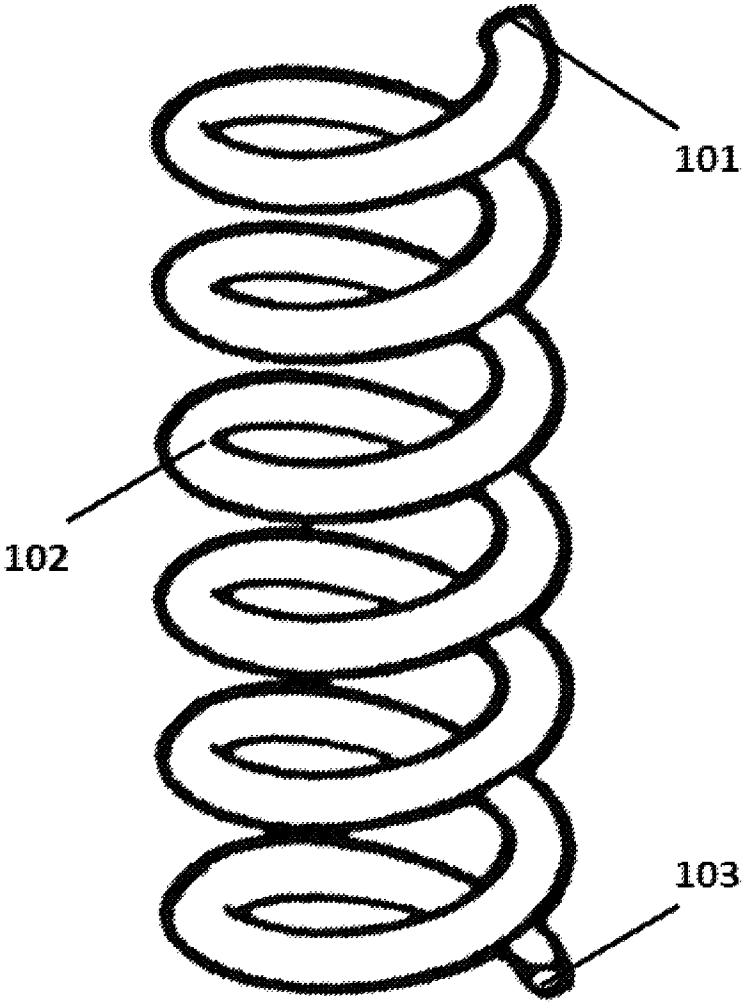

Referring to FIG. 1A and FIG. 1B, for example, the article has a top end 101, an exterior wall 102, and a bottom end 103. A composition as disclosed herein is contained inside of the article. As shown here, the article is coil-shaped, but other shapes, such as, for example, a straw shape, an elongated cylinder, an elongated tube, a spiral shape, and an oblong shape, are also envisioned. The coils of the article can be spaced apart, as shown in FIG. 1A, thereby allowing a larger surface area of the article to be exposed. Alternatively, the coils of the article can sit one on top of another, as shown in FIG. 1B. Without wishing to be bound by theory, other increments of space, either larger or smaller than shown in FIG. 1A and FIG. 1B, are also envisioned.

Figure 2B:
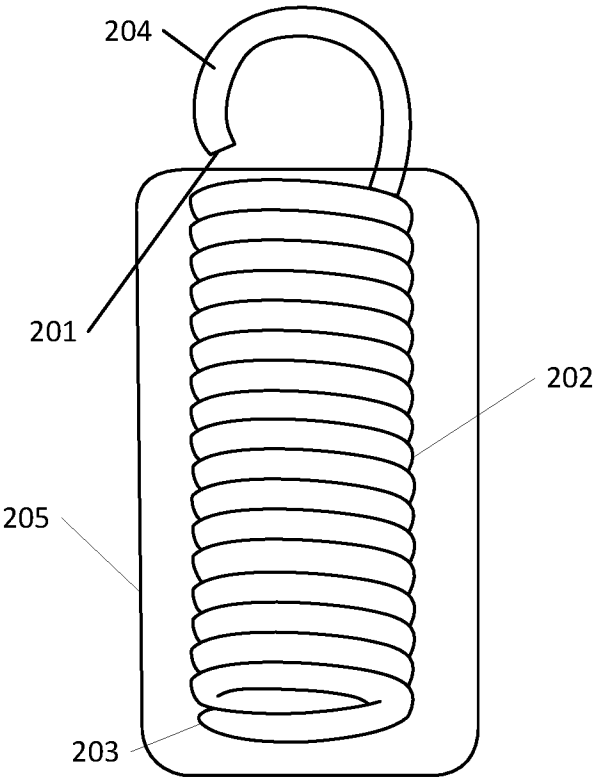
FIG. 2A and FIG. 2B show representative images of a coil-shaped cooling device having a handle or tag.
Figure 2A:
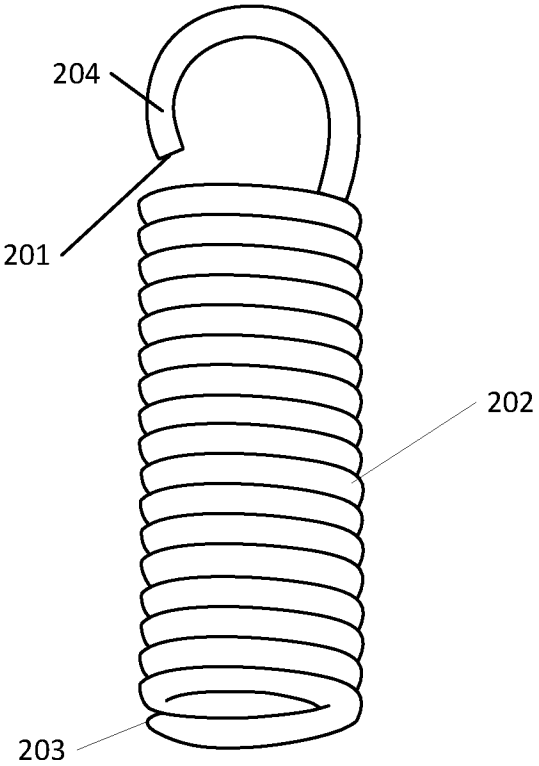

Referring to FIG. 2A and FIG. 2B, for example, the article has a top end 201, an exterior wall 202, a bottom end 203, and a tag 204. A composition as disclosed herein is contained inside of the article. As shown here, the article is coil-shaped, but other shapes, such as, for example, a straw shape, an elongated cylinder, an elongated tube, a spiral shape, and an oblong shape, are also envisioned. When placed into a container 205, tag 204 extends up and out of the container. In this way, a user can manipulate the article into and out of a liquid without having to touch the liquid itself. As shown here, the tag is shaped as a loop; however, the tag need not be shaped to provide a hole or opening. For example, the tag could be shaped as a flat extension of the article. Alternatively, the tag could be shaped as a diamond, an ellipse, a figure eight or any other shape that would extend up and out of the container and allow a user to grasp onto the tag and pull it out of the container.

Figure 3B:
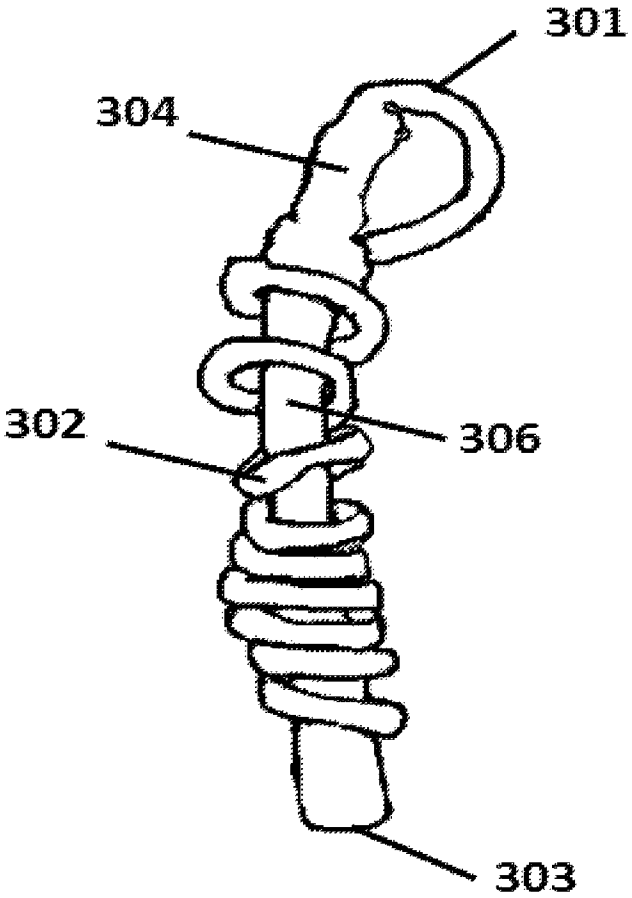
FIG. 3A-3D show representative images of a cooling device in which the handle is at both ends of the device (FIG. 3A), the device has a center portion around which the coils are wound (FIG. 3B), the center portion and the handle exist as a separate element from the coils (FIG. 3C), and the handle and coils are a single element (FIG. 3D).
Figure 3A:
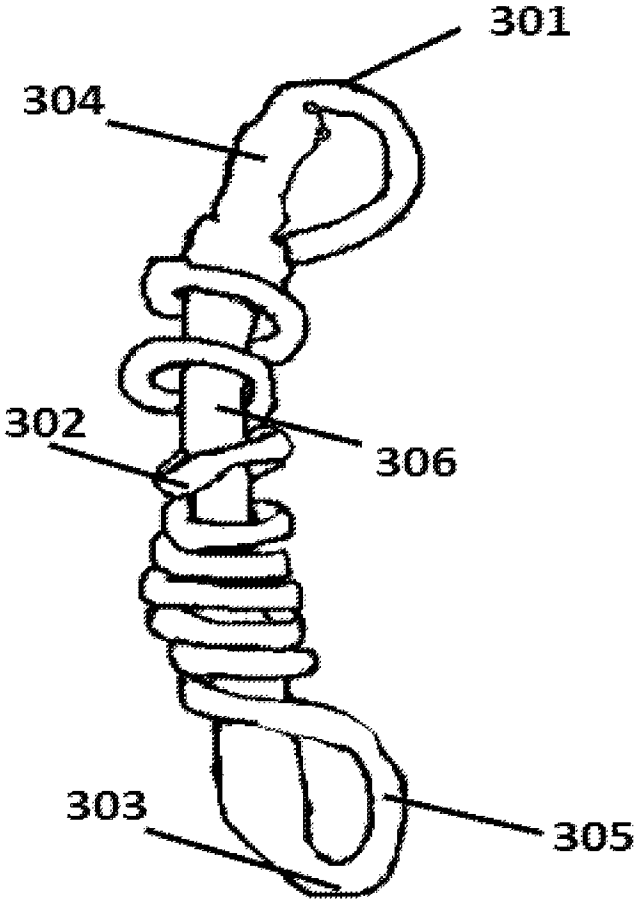

Referring to FIG. 3A, for example, the article has a top end 301, an exterior wall 302, a bottom end 303, and tags 304 and 305. A composition as disclosed herein is contained inside of the article. As shown here, the article is a single unit in which each of ends 301 and 303 have been looped back, thereby forming tags 304 and 305, and wrapped around a central component 306.

Referring to FIG. 3B, for example, the article has a top end 301, an exterior wall 302, a bottom end 303, and a tag 304. A composition as disclosed herein is contained inside of the article. As shown here, the article is a single unit in which top end 301 has been looped back, thereby forming tag 304, and wrapped around a central component 306.

Figure 3D:
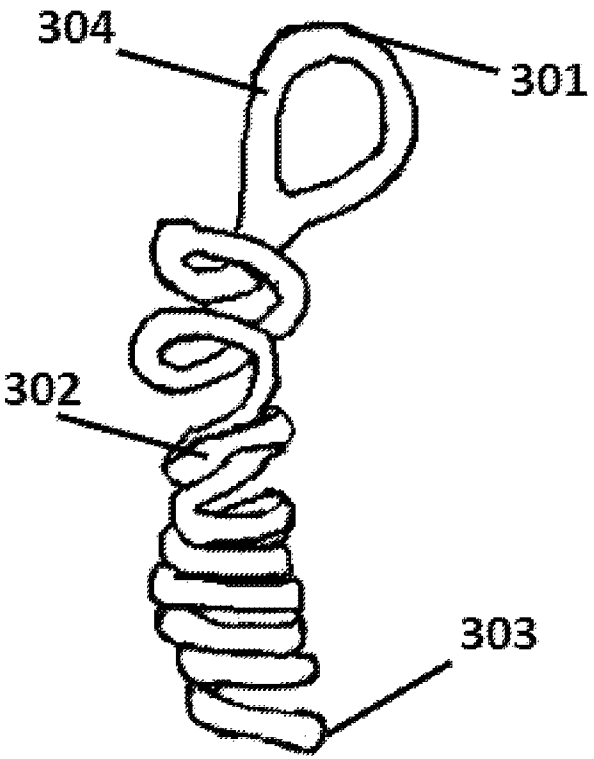
Figure 3C:
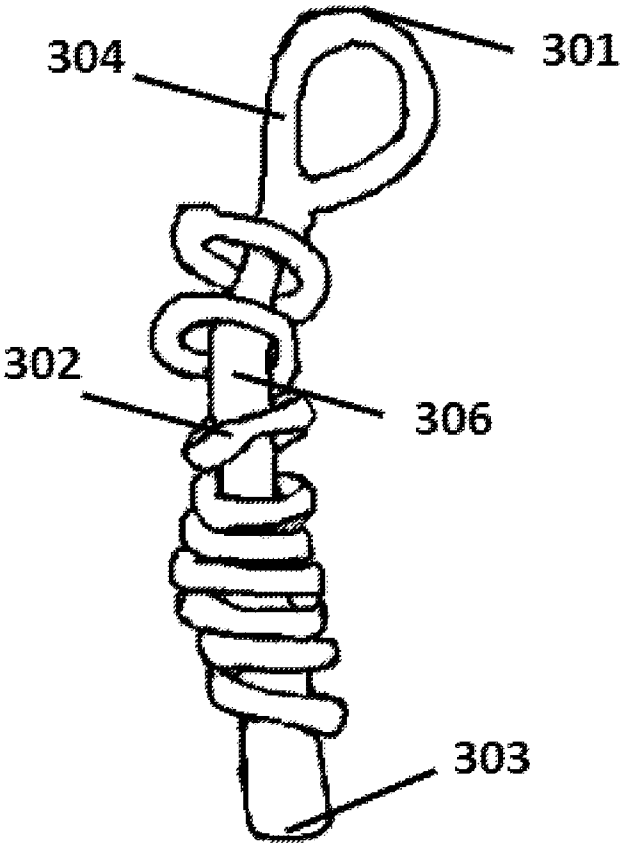

Referring to FIG. 3C, for example, the article has a top end 301, an exterior wall 302, a bottom end 303, and a tag 304. A composition as disclosed herein is contained inside of the article. As shown here, the article consists of two distinct units—one consisting of each of ends 301 and 303, tag 304, and a central component 306 and one consisting of loops wound around central component 306.

Referring to FIG. 3D, for example, the article has a top end 301, an exterior wall 302, a bottom end 303, and a tag 304. A composition as disclosed herein is contained inside of the article. As shown here, the article consists of a single unit in which top end 301 has been looped back, thereby forming tag 304, and wrapped into a coil shape.

Figure 5:
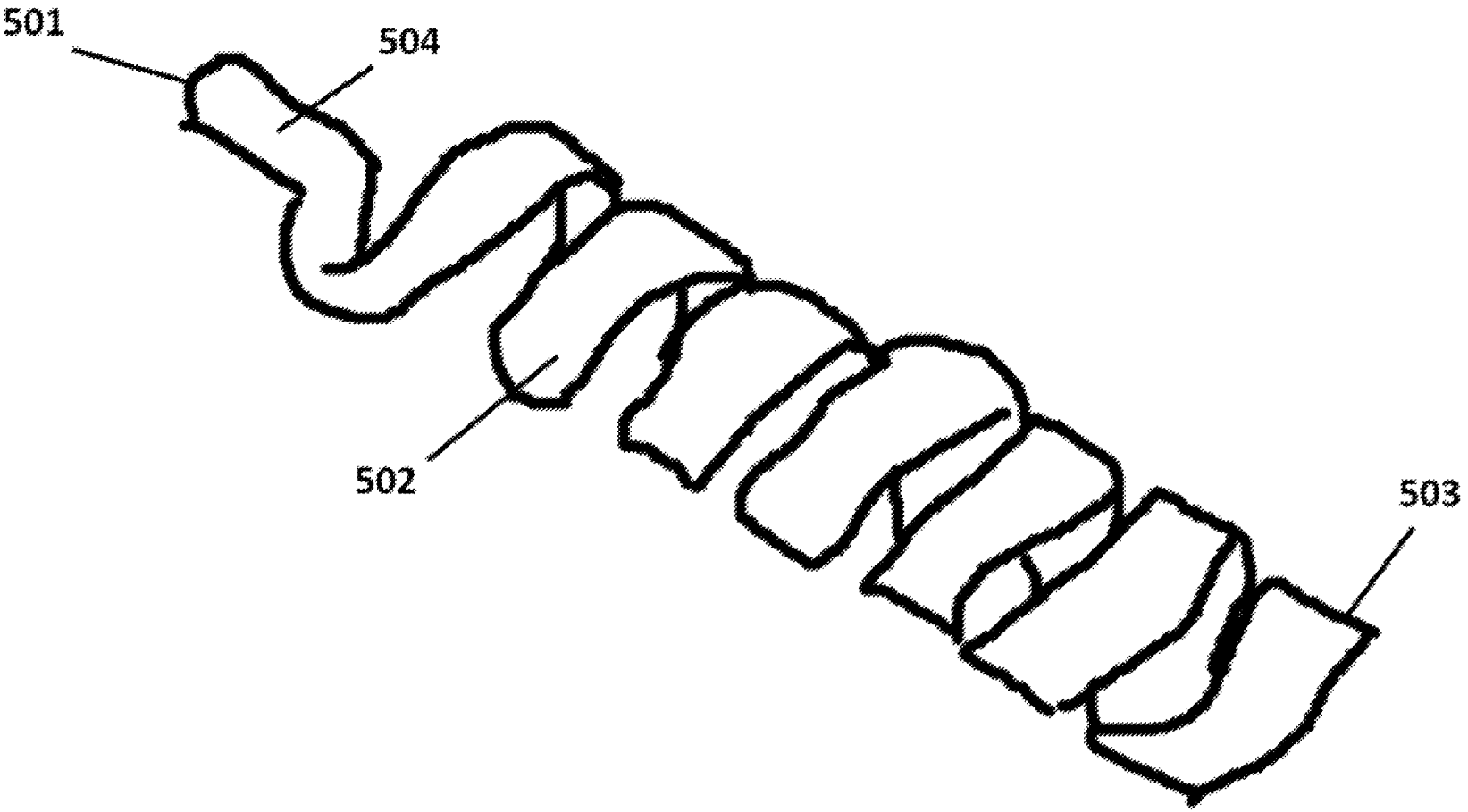
FIG. 5 shows a representative image of a coil-shaped cooling device having a handle, in which the handle and the coils are a single element.

Referring to FIG. 5, for example, the article has a top end 501, an exterior wall 502, a bottom end 503, and a tag 504. A composition as disclosed herein is contained inside of the article. As shown here, the article consists of a single unit. When placed into a container, tag 504 extends up and out of the container. In this way, a user can manipulate the article into and out of a liquid without having to touch the liquid itself. As shown here, the tag is shaped as an extension of the article; however, other shapes/configurations are also envisioned as described elsewhere herein.

In various aspects, the article has a density greater than water. Thus, the article can sink to the bottom of the container when immersed in most liquids. In various aspects, the article has a density less than water. Thus, the article can float in most liquids.

In various aspects, the article has a surface area that does not substantially inhibit heat transfer between the liquid and the composition. For example, the surface area of the article can be so large as to reduce the overall thermal resistance of the article (relative to a similar article with a spherical or cubic shape). Without wishing to be bound by theory, substantially low thermal resistance and a relatively high article surface area to composition volume ratio can improve the heat transfer rate between the liquid and the composition, thereby providing for faster cooling of the liquid.

In a further aspect, the article has a surface area to volume ratio of from about 5.0 to about 25, based on the exterior wall's surface area and the interior cavity's volume. In a still further aspect, the article has a surface area to volume ratio of from about 5.0 to about 20. In yet a further aspect, the article has a surface area to volume ratio of from about 5.0 to about 15. In an even further aspect, the article has a surface area to volume ratio of from about 5.0 to about 10. In a still further aspect, the article has a surface area to volume ratio of from about 10 to about 25. In yet a further aspect, the article has a surface area to volume ratio of from about 15 to about 25. In an even further aspect, the article has a surface area to volume ratio of from about 20 to about 25. In a still further aspect, the article has a surface area to volume ratio of from about 10 to about 20. In yet a further aspect, the article has a surface area to volume ratio of from about 12 to about 17.

In a further aspect, the article has a surface area to volume ratio of from about 3.0 to about 11, based on the exterior wall's surface area and the interior cavity's volume. In a still further aspect, the article has a surface area to volume ratio of from about 5.0 to about 11, based on the exterior wall's surface area and the interior cavity's volume. In yet a further aspect, the article has a surface area to volume ratio of from about 7.0 to about 11, based on the exterior wall's surface area and the interior cavity's volume. In an even further aspect, the article has a surface area to volume ratio of from about 3.0 to about 9.0, based on the exterior wall's surface area and the interior cavity's volume. In a still further aspect, the article has a surface area to volume ratio of from about 3.0 to about 7.0, based on the exterior wall's surface area and the interior cavity's volume. In yet a further aspect, the article has a surface area to volume ratio of from about 5.0 to about 9.0, based on the exterior wall's surface area and the interior cavity's volume. In an even further aspect, the article has a surface area to volume ratio of from about 6.0 to about 8.0, based on the exterior wall's surface area and the interior cavity's volume.

In a further aspect, the interior cavity has a volume of from about 5 $cm^3$ to about 25 $cm^3$. In a still further aspect, the interior cavity has a volume of from about 10 $cm^3$ to about 25 $cm^3$. In yet a further aspect, the interior cavity has a volume of from about 15 $cm^3$ to about 25 $cm^3$. In an even further aspect, the interior cavity has a volume of from about 20 $cm^3$ to about 25 $cm^3$. In a still further aspect, the interior cavity has a volume of from about 5 $cm^3$ to about 20 $cm^3$. In yet a further aspect, the interior cavity has a volume of from about 5 $cm^3$ to about 15 $cm^3$. In an even further aspect, the interior cavity has a volume of from about 5 $cm^3$ to about 10 $cm^3$. In a still further aspect, the interior cavity has a volume of from about 10 $cm^3$ to about 20 $cm^3$.

In a further aspect, the article has a widest diameter of from about 2.5 inches to about 4.2 inches, and the article has a length of from about 5.5 inches to about 12.5 inches. In a still further aspect, the article has a widest diameter of from about 2.5 inches to about 4.0 inches, and the article has a length of from about 5.5 inches to about 11.5 inches. In yet a further aspect, the article has a widest diameter of from about 2.5 inches to about 3.5 inches, and the article has a length of from about 5.5 inches to about 10.5 inches. In an even further aspect, the article has a widest diameter of from about 2.5 inches to about 3.0 inches, and the article has a length of from about 5.5 inches to about 9.5 inches. In a still further aspect, the article has a widest diameter of from about 3.0 inches to about 4.2 inches, and the article has a length of from about 6.5 inches to about 12.5 inches. In yet a further aspect, the article has a widest diameter of from about 3.5 inches to about 4.2 inches, and the article has a length of from about 7.5 inches to about 12.5 inches. In an even further aspect, the article has a widest diameter of from about 4.0 inches to about 4.2 inches, and the article has a length of from about 8.5 inches to about 12.5 inches. In a still further aspect, the article has a widest diameter of from about 3.0 inches to about 4.0 inches, and the article has a length of from about 6.5 inches to about 10.5 inches.

In a further aspect, the article has a widest diameter of from about 3.0 inches to about 4.0 inches. In a still further aspect, the article has a widest diameter of from about 3.0 inches to about 3.8 inches. In yet a further aspect, the article has a widest diameter of from about 3.0 inches to about 3.6 inches. In an even further aspect, the article has a widest diameter of from about 3.0 inches to about 3.4 inches. In a still further aspect, the article has a widest diameter of from about 3.0 inches to about 3.2 inches. In yet a further aspect, the article has a widest diameter of from about 3.2 inches to about 4.0 inches. In an even further aspect, the article has a widest diameter of from about 3.4 inches to about 4.0 inches. In a still further aspect, the article has a widest diameter of from about 3.6 inches to about 4.0 inches. In yet a further aspect, the article has a widest diameter of from about 3.8 inches to about 4.0 inches.

In a further aspect, the article has a length of from about 5.5 inches to about 8.0 inches. In a still further aspect, the article has a length of from about 5.5 inches to about 7.5 inches. In yet a further aspect, the article has a length of from about 5.5 inches to about 7.0 inches. In an even further aspect, the article has a length of from about 5.5 inches to about 6.5 inches. In a still further aspect, the article has a length of from about 5.5 inches to about 6.0 inches. In yet a further aspect, the article has a length of from about 6.0 inches to about 8.0 inches. In an even further aspect, the article has a length of from about 6.5 inches to about 8.0 inches. In a still further aspect, the article has a length of from about 7.0 inches to about 8.0 inches. In yet a further aspect, the article has a length of from about 7.5 inches to about 8.0 inches.

In a further aspect, the article has a length of from about 9.0 inches to about 12.5 inches. In a still further aspect, the article has a length of from about 9.0 inches to about 12.0 inches. In yet a further aspect, the article has a length of from about 9.0 inches to about 11.5 inches. In an even further aspect, the article has a length of from about 9.0 inches to about 11.0 inches. In a still further aspect, the article has a length of from about 9.0 inches to about 10.5 inches. In yet a further aspect, the article has a length of from about 9.0 inches to about 10.0 inches. In an even further aspect, the article has a length of from about 9.0 inches to about 9.5 inches. In a still further aspect, the article has a length of from about 9.5 inches to about 12.5 inches. In yet a further aspect, the article has a length of from about 10.0 inches to about 12.5 inches. In an even further aspect, the article has a length of from about 10.5 inches to about 12.5 inches. In a still further aspect, the article has a length of from about 11.0 inches to about 12.5 inches. In yet a further aspect, the article has a length of from about 11.5 inches to about 12.5 inches. In an even further aspect, the article has a length of from about 12.0 inches to about 12.5 inches.

In various aspects, the article has a shape (i.e., geometry) that does not substantially inhibit heat transfer between the liquid and the composition. For example, an elongated shape can reduce the mean heat path length (relative to another shape such as, for example, a cube, a sphere, or a bean) between sub-volumes of the composition and the liquid. By reducing the distance between the exterior wall and sub-volumes of the composition, absorption of thermal energy into the composition is substantially more uniform throughout the volume of the composition within the interior cavity. Thus, without wishing to be bound by theory, the relatively short heat path between sub-volumes of the composition and the beverage can improve the maximum rate of heat absorption into the composition, distribute thermal energy more uniformly within the composition, and provide a more uniform phase transition of the composition.

In various aspects, the shape of the article is coiled. This can increase the contact area between the article and the liquid, substantially maximizing the heat transfer between the article and the liquid, while not taking up a substantial amount of the space within the container available for the liquid.

In a further aspect, the article has a coil shape. In a still further aspect, the article has a straw shape (i.e., shaped like a beverage straw). In yet a further aspect, the article is shaped like an elongated tube. In an even further aspect, the article is shaped like an elongated cylinder. In a still further aspect, the article has a spiral shape. In yet a further aspect, the article has an oblong shape.

In various aspects, the apparatus can further comprise a tag connected to the top end. Without wishing to be bound by theory, a tag can be used to insert and/or remove the article from a beverage. Thus, after the article is inserted into a liquid, it is preferable that the tag would remain outside of the liquid. Once the liquid has cooled to the desired temperature, the article can be extracted merely by lifting the article out of the liquid via the tag.

In a further aspect, the tag is molded or glued to the top end.

In various aspects, the container is a beverage container. Examples of beverage containers include, but are not limited to, infant bottles, thermoses, glasses, cups, and mugs. In a further aspect, the container is an infant bottle.

In various aspects, the container is a food container. Examples of food containers include, but are not limited to, bowls, basins, porringers, crocks, pots, and vessels.

1. Shells

In various aspects, the top end, the bottom end, the exterior wall, and the interior wall together comprise a shell in which the composition is wholly contained. The shell retains the composition in the interior cavity that is separate from the liquid. In various aspects, the shell conducts thermal energy between the composition and liquid.

Thus, in one aspect, the article comprises a top end and a bottom end.

Thus, in one aspect, the article comprises an exterior wall extending from the top end to the bottom end and an interior wall extending from the top end to the bottom end and defining an interior cavity. In one aspect, the article comprises an exterior wall extending from the top end to the bottom end and having a coil shape and an interior wall extending from the top end to the bottom end and defining an interior cavity.

The thickness of the exterior wall and interior wall together ("the walls") is sufficient to resist plastic (e.g., permanent) deformation of the walls under average use. Thus, in various aspects, the thickness of the walls is sufficient to resist, for example, dents or dings when dropped into an empty container or dropped onto a granite surface from a height, e.g., one foot. However, the thickness of the walls is sufficiently thin to limit the thermal resistance of the walls and thus not substantially inhibit heat transfer between the composition and the beverage. Additionally, the thickness of the walls is sufficiently thin to limit the heat capacity of the walls themselves. Thus, in various aspects, the walls comprise plastic and have a thickness of from about 0.10 millimeters to about 2.0 millimeters.

In a further aspect, the walls have a thickness of from about 0.10 millimeters to about 2.0 millimeters. In a still further aspect, the walls have a thickness of from about 0.10 millimeters to about 1.5 millimeters. In yet a further aspect, the walls have a thickness of from about 0.10 millimeters to about 1.0 millimeter. In an even further aspect, the walls have a thickness of from about 0.10 millimeters to about 0.75 millimeters. In a still further aspect, the walls have a thickness of from about 0.10 millimeters to about 0.50 millimeters. In yet a further aspect, the walls have a thickness of from about 0.25 millimeters to about 2.0 millimeters. In an even further aspect, the walls have a thickness of from about 0.50 millimeters to about 2.0 millimeters. In a still further aspect, the walls have a thickness of from about 0.75 millimeters to about 2.0 millimeters. In yet a further aspect, the walls have a thickness of from about 1.0 millimeter to about 2.0 millimeters. In an even further aspect, the walls have a thickness of from about 0.25 millimeters to about 1.5 millimeters. In a still further aspect, the walls have a thickness of from about 0.5 millimeters to about 1.5 millimeters. In yet a further aspect, the walls have a thickness of about 1.0 millimeter.

In a further aspect, the walls have a thermal conductivity of from about 1.5 $W*m^{-1}K^{-1}$ to about 3.0 $W*m^{-1}K^{-1}$ at a temperature of from about 0° C. to about 20° C. In a still further aspect, the walls have a thermal conductivity of from about 1.5 $W*m^{-1}K^{-1}$ to about 2.5 $W*m^{-1}K^{-1}$ at a temperature of from about 0° C. to about 20° C. In yet a further aspect, the walls have a thermal conductivity of from about 1.5 $W*m^{-1}K^{-1}$ to about 2.0 $W*m^{-1}K^{-1}$ at a temperature of from about 0° C. to about 20° C. In an even further aspect, the walls have a thermal conductivity of from about 2.0 $W*m^{-1}K^{-1}$ to about 3.0 $W*m^{-1}K^{-1}$ at a temperature of from about 0° C. to about 20° C. In a still further aspect, the walls have a thermal conductivity of from about 2.5 $W*m^{-1}K^{-1}$ to about 3.0 $W*m^{-1}K^{-1}$ at a temperature of from about 0° C. to about 20° C.

In a further aspect, the exterior wall has a surface area of from about 175 $cm^2$ to about 275 $cm^2$. In a still further aspect, the exterior wall has a surface area of from about 200 $cm^2$ to about 275 $cm^2$. In yet a further aspect, the exterior wall has a surface area of from about 225 $cm^2$ to about 275 $cm^2$. In an even further aspect, the exterior wall has a surface area of from about 250 $cm^2$ to about 275 $cm^2$. In a still further aspect, the exterior wall has a surface area of from about 175 $cm^2$ to about 250 $cm^2$. In yet a further aspect, the exterior wall has a surface area of from about 175 $cm^2$ to about 225 $cm^2$. In an even further aspect, the exterior wall has a surface area of from about 175 $cm^2$ to about 200 $cm^2$. In a still further aspect, the exterior wall has a surface area of from about 200 $cm^2$ to about 250 $cm^2$. In yet a further aspect, the exterior wall has a surface area of from about 210 $cm^2$ to about 225 $cm^2$.

In a further aspect, the exterior wall has a thermal conductivity of from about 1.5 $W*m^{-1}K^{-1}$ to about 3.0 $W*m^{-1}K^{-1}$ at a temperature of from about 0° C. to about 20° C. In a still further aspect, the exterior wall has a thermal conductivity of from about 1.5 $W*m^{-1}K^{-1}$ to about 2.5 $W*m^{-1}K^{-1}$ at a temperature of from about 0° C. to about 20° C. In yet a further aspect, the exterior wall has a thermal conductivity of from about 1.5 $W*m^{-1}K^{-1}$ to about 2.0 $W*m^{-1}K^{-1}$ at a temperature of from about 0° C. to about 20° C. In an even further aspect, the exterior wall has a thermal conductivity of from about 2.0 $W*m^{-1}K^{-1}$ to about 3.0

$W*m^{-1}K^{-1}$ at a temperature of from about 0° C. to about 20° C. In a still further aspect, the exterior wall has a thermal conductivity of from about 2.5 $W*m^{-1}K^{-1}$ to about 3.0 $W*m^{-1}K^{-1}$ at a temperature of from about 0° C. to about 20° C.

In a further aspect, the shell consists essentially of one or more non-toxic materials. Examples of non-toxic materials include, but are not limited to, polyethylene terephthalate, polypropylene, high-density polyethylene, low-density polyethylene, and polycarbonate.

In a further aspect, the exterior wall and the interior wall consist essentially of one or more non-toxic materials. Examples of non-toxic materials include, but are not limited to, polyethylene terephthalate, polypropylene, high-density polyethylene, low-density polyethylene, and polycarbonate.

2. Compositions that Undergo Phase Transitions

In one aspect, the disclosed article comprises a composition that undergoes a phase transition when the temperature is raised from less than about 0° C. to greater than about 20° C., wherein the composition is contained within the interior cavity.

In one aspect, the disclosed article comprises a composition that undergoes a phase transition upon application of an external force, wherein the composition is contained within the interior cavity.

In various aspects, the composition has one or more of the following properties: (1) is a solid at a temperature of about 0° C. or less; (2) is a liquid at a temperature of about 20° C. or more; (3) has a low specific heat; (4) has a high heat of fusion; and (5) has a phase transition temperature substantially similar to the appropriate consumption temperature (or within a range of appropriate consumption temperatures) of the liquid. A relatively low specific heat allows the composition to rise to the phase transition temperature relatively quickly without absorbing a substantially large amount of thermal energy from the beverage. Without wishing to be bound by theory, this may be enable the liquid to cool in a short period of time. Additionally, the liquid will still maintain some heat and thus, not have been overly cooled. A relatively high heat of fusion allows the composition to absorb a relatively large amount of thermal energy, from the liquid, substantially isothermally (e.g., at the phase transition temperature).

In various aspects, the composition absorbs thermal energy from the liquid during, for example, a solid-to-liquid phase transition. In various aspects, this thermal energy can then be released back into the liquid isothermally, maintaining the temperature of the liquid (i.e., at the phase transition temperature).

In various aspects, the phase transition temperature of the composition is from less than about 0° C. to greater than about 20° C. In a further aspect, the phase transition temperature of the composition is from about 0° C. to about 20° C.

In various aspects, the phase transition temperature of the composition is in the range of appropriate consumption temperatures of the liquid. In a further aspect, the phase transition temperature of the composition is from less than about 51° C. to greater than about 68° C. In a still further aspect, the phase transition temperature of the composition is from about 45° C. to about 68° C. In yet a further aspect, the phase transition temperature of the composition is from less than about 0° C. to greater than about 35° C. In an even further aspect, the phase transition temperature of the composition is from about 0° C. to about 35° C. In a still further aspect, the phase transition temperature of the composition is from about 36° C. to about 39° C. In yet a further aspect, the phase transition temperature of the composition is from about 37° C. to about 38° C.

In various aspects, the composition is a phase change material (PCM). PCM's can be water-based, salt hydrates, paraffins, and vegetable-based (aka biobased).

Thus, in various aspects, the composition is a water-based PCM. Advantages of water-based PCMs include, but are not limited to, being nontoxic, non-flammable, and environmentally friendly.

In various aspects, the composition is a salt hydrate PCM. In a further aspect, the salt hydrate PCM has a melting point temperature range of from about 20° C. to about 30° C. Advantages of salt hydrate PCMs include, but are not limited to, low material costs, high latent heat storage capacity, precise melting point, high thermal conductivity, and inflammability.

In various aspects, the composition is a paraffin PCM. In a further aspect, the paraffin PCM has a melting point temperature range of from about 20° C. to about 30° C. Advantages of paraffin PCM's include, but are not limited to, chemical stability, being non-corrosive, and having a good thermal storage capacity.

In various aspects, the composition is a vegetable-based (biobasd) PCM. In a further aspect, the vegetable-based PCM has a melting point temperature range of from about 20° C. to about 30° C. Vegetable-based PCMs include compounds derived from animal fat and plant oils. Advantages of vegetable-based PCMs include, but are not limited to, being nontoxic, biodegradable, they experience minimal volume change between phases, stability, high latent heat, and being fire-resistant. In various aspects, the vegetable-based PCM comprises one or more of palm oil, palm kernel oil, rapeseed oil, coconut oil, and soybean oil.

In various aspects, the composition is non-corrosive (i.e., does not corrode any material comprising the top end, the bottom end, the exterior wall, the interior wall, the container, or the liquid). In various aspects, the composition is food safe (i.e., not harmful if consumed by an individual). In various aspects, the composition is non-toxic and/or non-carcinogenic.

In a further aspect, the composition has one or more of water, silica gel, and hydroxyethyl cellulose. In a still further aspect, the composition comprises water and silica gel. In yet a further aspect, the composition comprises water and hydroxyethyl cellulose. In an even further aspect, the composition comprises silica gel and hydroxyethyl cellulose. In a still further aspect, the composition comprises water, silica gel, and hydroxyethyl cellulose.

In a further aspect, the composition consists essentially of water and silica gel. In a still further aspect, the composition consists essentially of water.

In a further aspect, the composition consists essentially of water and hydroxyethyl cellulose. In a still further aspect, the composition consists essentially of water, silica gel, and hydroxyethyl cellulose.

In a further aspect, the interior cavity is partially filled with the composition.

In a further aspect, the external force is shaking. In a still further aspect, the external force is bending.

In a further aspect, the composition consists essentially of water and ammonium nitrate.

C. Containers for Cooling a Liquid

In one aspect, disclosed are containers for cooling a liquid contained within the container, wherein the container comprises: (a) an upper edge defining a hole; (b) a bottom end; (c) an exterior wall extending from the upper edge to the bottom end; (d) an interior wall extending from the upper edge to the bottom wall, wherein the exterior wall and interior wall together define an interior cavity; and (e) a composition that undergoes a phase transition when the temperature is raised from less than about 0° C. to greater than about 20° C., wherein the composition is contained within the interior cavity, and wherein the exterior wall and the interior wall consist essentially of one or more non-toxic materials. In a further aspect, the upper edge is configured to reversibly attach to a bottle nipple.

Figure 4B:
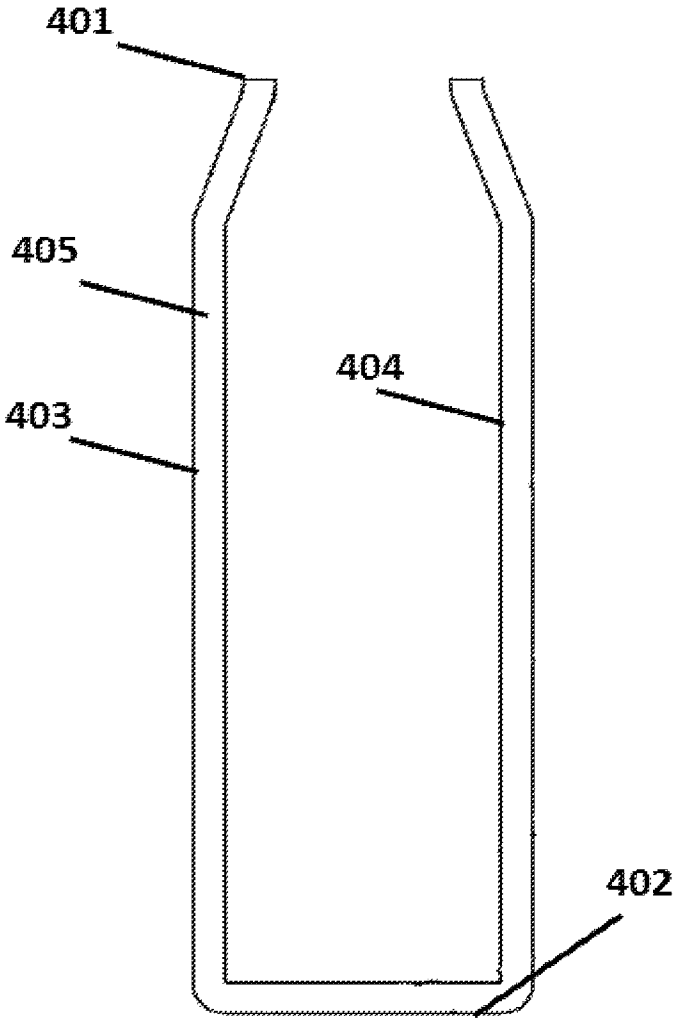
FIG. 4A and FIG. 4B show representative images of a container that cools a liquid. Specifically, a side view (FIG. 4A) and a cross-sectional side view (FIG. 4B) are shown.
Figure 4A:
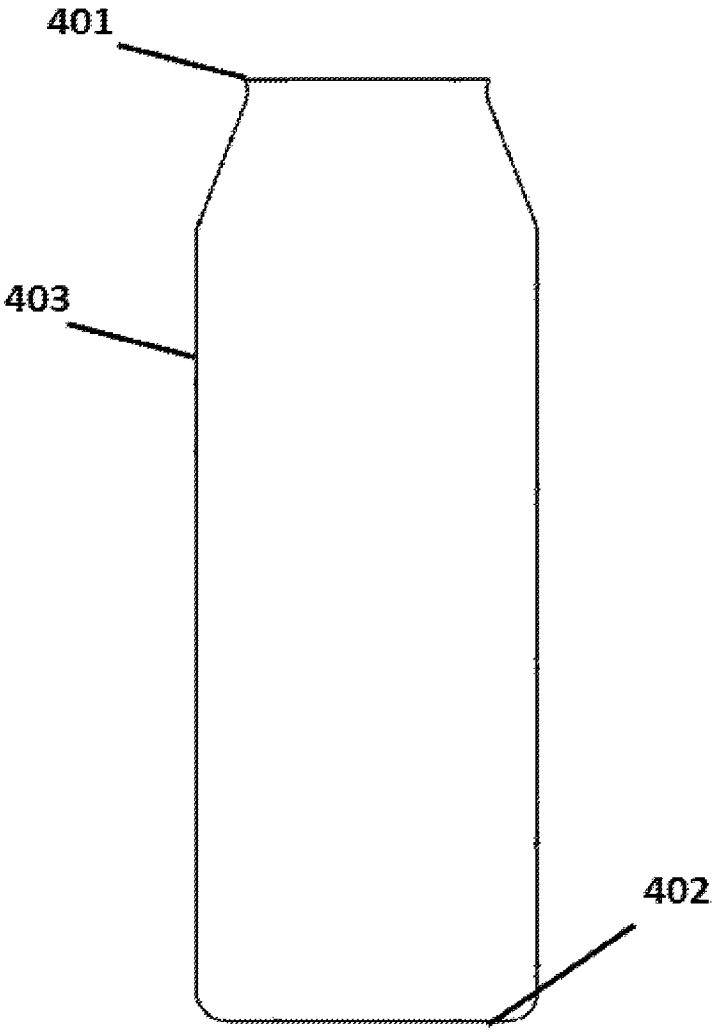

Referring to FIG. 4A and FIG. 4B, for example, the container has an upper edge 401 defining a hole, a bottom end 402, an exterior wall 403 extending from upper edge 401 to bottom end 402, an interior wall 404, and an interior cavity 405. A composition as disclosed herein is contained inside of the interior cavity. As shown here, the container is a bottle, but other containers, such as, for example, a mug, a thermos, a glass, and a cup, are also envisioned. Additionally, as shown here, the bottle is tall and narrow, but other shapes of bottles, such as, for example, short and wide, are also envisioned. Exterior wall 403 and interior wall 404 are spaced apart, as shown in FIG. 4B, thereby forming interior cavity 405, which contains a disclosed composition. Although the space between exterior wall 403 and interior wall 404 is relatively narrow, as shown in FIG. 4B, other increments of space, either larger or smaller than shown in FIG. 1B, are also envisioned.

Without wishing to be bound by theory, the disclosed invention generally relates to the field of cooling liquids such as, for example, infant formula or milk, via pouring the liquid into the container. In this aspect, the cooling device is the container itself. Thus, the container is first cooled by, for example, storing the container in a freezer for a period of time sufficient to cool the container and then pouring the hot liquid into the container. Heat is then transferred from the liquid to the composition within the interior cavity (i.e., the space between the interior and exterior walls), thereby cooling the liquid.

In various aspects, the container is a beverage container. Examples of beverage containers include, but are not limited to, infant bottles, thermoses, glasses, cups, and mugs. In a further aspect, the container is an infant bottle.

In various aspects, the container is a food container. Examples of food containers include, but are not limited to, bowls, basins, porringers, crocks, pots, and vessels.

D. Methods for Cooling a Liquid

In one aspect, disclosed are disclosed are methods for cooling a liquid in a container, the method comprising the step of inserting a disclosed article into the liquid, wherein the container comprises an interior wall defining an interior cavity and wherein the liquid is contained within the interior cavity.

In various aspects, the disclosed article comprises: (a) a top end and a bottom end; (b) an exterior wall extending from the top end to the bottom end; (c) an interior wall extending from the top end to the bottom end and defining an interior cavity; and (d) a composition that undergoes a phase transition when the temperature is raised from less than about 0° C. to greater than about 20° C., wherein the composition is contained within the interior cavity, wherein the exterior wall and the interior wall consist essentially of one or more non-toxic materials, and wherein the article has a surface area to volume ratio of from about 5.0 to about 25, based on the exterior wall's surface area and the interior cavity's volume.

In various aspects, the disclosed article comprises: (a) a top end and a bottom end; (b) an exterior wall extending from the top end to the bottom end and having a coil shape; (c) an interior wall extending from the top end to the bottom end and defining an interior cavity; and (d) a composition that undergoes a phase transition when the temperature is raised from less than about 0° C. to greater than about 20° C., wherein the composition is contained within the interior cavity, wherein the exterior wall and the interior wall consist essentially of one or more non-toxic materials.

In various aspects, the disclosed article comprises: (a) a top end and a bottom end; (b) an exterior wall extending from the top end to the bottom end; (c) an interior wall extending from the top end to the bottom end and defining an interior cavity; and (d) a composition that undergoes a phase transition upon application of an external force, wherein the composition is contained within the interior cavity, wherein the exterior wall and the interior wall consist essentially of one or more non-toxic materials, and wherein the article has a surface area to volume ratio of from about 5.0 to about 25, based on the exterior wall's surface area and the interior cavity's volume.

In various aspects, the disclosed article comprises: (a) a top end and a bottom end; (b) an exterior wall extending from the top end to the bottom end and having a coil shape; (c) an interior wall extending from the top end to the bottom end and defining an interior cavity; and (d) a composition that undergoes a phase transition upon application of an external force, wherein the composition is contained within the interior cavity, wherein the exterior wall and the interior wall consist essentially of one or more non-toxic materials.

In a further aspect, the article further comprises a tag and wherein the tag remains outside of the liquid. A tag can be used, for example, to insert and/or remove the article from a beverage.

In a further aspect, the method further comprises the step of maintaining the article in the liquid until the liquid is at a temperature of at least about 21° C. In a still further aspect, the method further comprises the step of maintaining the article in the liquid until the liquid is at a temperature of at least about 20° C. In yet a further aspect, the method further comprises the step of maintaining the article in the liquid until the liquid is at a temperature of at least about 19° C. In an even further aspect, the method further comprises the step of maintaining the article in the liquid until the liquid is at a temperature of at least about 22° C. In a still further aspect, the method further comprises the step of maintaining the article in the liquid until the liquid is at a temperature of at least about 23° C.

In a further aspect, the method further comprises the step of removing the article from the liquid.

In various aspects, the container is a beverage container. Examples of beverage containers include, but are not limited to, infant bottles, thermoses, glasses, cups, and mugs. In a further aspect, the container is an infant bottle.

In various aspects, the container is a food container. Examples of food containers include, but are not limited to, bowls, basins, porringers, crocks, pots, and vessels.

E. Kits

In one aspect, disclosed are kits comprising a disclosed article and one or more of: (a) a container; and (b) instructions for cooling a liquid in a container. For example, in various aspects the kit is a beverage accessory kit.

In various aspects, the disclosed article comprises: (a) a top end and a bottom end; (b) an exterior wall extending from the top end to the bottom end; (c) an interior wall extending from the top end to the bottom end and defining an interior cavity; and (d) a composition that undergoes a phase transition when the temperature is raised from less than about 0° C. to greater than about 20° C., wherein the composition is contained within the interior cavity, wherein the exterior wall and the interior wall consist essentially of one or more non-toxic materials, and wherein the article has a surface area to volume ratio of from about 5.0 to about 25, based on the exterior wall's surface area and the interior cavity's volume.

In various aspects, the disclosed article comprises: (a) a top end and a bottom end; (b) an exterior wall extending from the top end to the bottom end and having a coil shape; (c) an interior wall extending from the top end to the bottom end and defining an interior cavity; and (d) a composition that undergoes a phase transition when the temperature is raised from less than about 0° C. to greater than about 20° C., wherein the composition is contained within the interior cavity, wherein the exterior wall and the interior wall consist essentially of one or more non-toxic materials.

In various aspects, the disclosed article comprises: (a) a top end and a bottom end; (b) an exterior wall extending from the top end to the bottom end; (c) an interior wall extending from the top end to the bottom end and defining an interior cavity; and (d) a composition that undergoes a phase transition upon application of an external force, wherein the composition is contained within the interior cavity, wherein the exterior wall and the interior wall consist essentially of one or more non-toxic materials, and wherein the article has a surface area to volume ratio of from about 5.0 to about 25, based on the exterior wall's surface area and the interior cavity's volume.

In various aspects, the disclosed article comprises: (a) a top end and a bottom end; (b) an exterior wall extending from the top end to the bottom end and having a coil shape; (c) an interior wall extending from the top end to the bottom end and defining an interior cavity; and (d) a composition that undergoes a phase transition upon application of an external force, wherein the composition is contained within the interior cavity, wherein the exterior wall and the interior wall consist essentially of one or more non-toxic materials.

In various aspects, the kit comprises a plurality of disclosed articles. The articles can be substantially identical and sized for the same specific volume of the liquid (e.g., about 4 ounces to about 6 ounces or about 8 ounces to about 10 ounces per article). Alternatively, the articles can be sized for different volumes of the liquid (e.g., one apparatus for each of 4 to 6 ounces and 8 to 10 ounces).

In various aspects, the kit further comprises a sack, satchel, box, or other container to store the articles when not in use.

In various aspects, the container is a beverage container. Examples of beverage containers include, but are not limited to, infant bottles, thermoses, glasses, cups, and mugs. In a further aspect, the container is an infant bottle.

In various aspects, the container is a food container. Examples of food containers include, but are not limited to, bowls, basins, porringers, crocks, pots, and vessels.

It will be apparent to those skilled in the art that various modifications and variations can be made in the present invention without departing from the scope or spirit of the invention. Other aspects of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An article for cooling a liquid contained within an infant bottle, wherein the article comprises:

(a) a top end and a bottom end;

(b) an exterior wall extending from the top end to the bottom end;

(c) an interior wall extending from the top end to the bottom end and defining an interior cavity; and (d) a composition that undergoes a phase transition when the temperature is raised from less than about 0° C. to greater than about 20° C. or upon application of an external force, wherein the composition is sealed within the interior cavity, wherein the exterior wall and the interior wall consist essentially of one or more non-toxic materials, wherein the article has a surface area to volume ($cm^2/cm^3$) ratio of from about 5.0 to about 25, based on the exterior wall's surface area and the interior cavity's volume, and wherein the article is configured for insertion into the liquid.

2. The article of claim 1, wherein the article has a surface area to volume ($cm^2/cm^3$) ratio of from about 10 to about 20.

3. The article of claim 1, wherein the exterior wall has a thickness of from about 0.10 millimeters to about 2.0 millimeters.

4. The article of claim 1, wherein the exterior wall has a thermal conductivity of from about 1.5 $W*m^{-1}K^{-1}$ to about 3.0 $W*m^{-1}K^{-1}$ at a temperature of from about 0° C. to about 20° C.

5. The article of claim 1, wherein the non-toxic material is selected from polyethylene terephthalate, polypropylene, high-density polyethylene, low-density polyethylene, and polycarbonate.

6. The article of claim 1, wherein the composition has one or more of water, silica gel, and hydroxyethyl cellulose.

7. The article of claim 1, wherein the composition consists essentially of water and silica gel.

8. The article of claim 1, wherein the composition consists essentially of water and hydroxyethyl cellulose.

9. The article of claim 1, wherein the interior cavity is partially filled with the composition.

10. The article of claim 1, wherein the article has a widest diameter of from about 2.5 inches to about 4.2 inches, and wherein the article has a length of from about 5.5 inches to about 12.5 inches.

11. The article of claim 10, wherein the article has a widest diameter of from about 3.0 inches to about 4.0 inches.

12. The article of claim 10, wherein the article has a length of from about 5.5 inches to about 8.0 inches.

13. The article of claim 10, wherein the article has a length of from about 9.0 inches to about 12.5 inches.

14. The article of claim 10, wherein the article has a coil shape.

15. The article of claim 1, wherein the composition comprises water.

16. The article of claim 1, wherein the interior cavity has a volume of from about 5 $cm^3$ to about 25 $cm^3$.

17. The article of claim 1, wherein the article further comprises a tag connected to the top end, wherein the tag is configured to lift the article into and out of the liquid.

18. An article for cooling a liquid contained within an infant bottle, wherein the article comprises:

(a) a top end and a bottom end;

(b) an exterior wall extending from the top end to the bottom end and having a coil shape;

(c) an interior wall extending from the top end to the bottom end and defining an interior cavity, wherein the interior cavity has a volume of from about 5 $cm^3$ to about 25 $cm^3$; and (d) a composition that undergoes a phase transition when the temperature is raised from less than about 0° C. to greater than about 20° C. or upon application of an external force, wherein the composition is sealed within the interior cavity, and wherein the composition consists essentially of water, wherein the exterior wall and the interior wall consist essentially of one or more non-toxic materials, wherein the article has a surface area to volume ($cm^2/cm^3$) ratio of from about 5.0 to about 25, based on the exterior wall's surface area and the interior cavity's volume, and wherein the article is configured for insertion into the liquid.

* * * * *